US005732855A

United States Patent [19]

van der Heijden

[11] Patent Number: 5,732,855

[45] Date of Patent: Mar. 31, 1998

[54] SPRAY HEAD INTENDED FOR A SPRAY CAN, AND SPRAY CAN PROVIDED WITH SUCH A SPRAY HEAD

[75] Inventor: Edgar Ivo Maria van der Heijden, Alkmaar, Netherlands

[73] Assignee: Park Towers International B.V., Beverwijk, Netherlands

[21] Appl. No.: 609,192

[22] Filed: Mar. 4, 1996

[30] Foreign Application Priority Data

Mar. 6, 1995 [NL] Netherlands ..... 9500438

[51] Int. Cl.[6] ..... B65D 83/00

[52] U.S. Cl. ..... 222/402.12; 222/402.13; 222/571

[58] Field of Search ..... 222/108, 571, 222/402.11, 402.12, 402.13, 402.16

[56] References Cited

U.S. PATENT DOCUMENTS

| | | | |
|---|---|---|---|
| 2,894,660 | 7/1959 | Gordon | 222/108 |
| 3,250,474 | 5/1966 | McKernan | 222/402.12 |
| 3,913,803 | 10/1975 | Laauwe . | |
| 4,978,035 | 12/1990 | Bruno et al. . | |

FOREIGN PATENT DOCUMENTS

| | | | |
|---|---|---|---|
| 0 370 842 | 10/1989 | European Pat. Off. . | |
| 2 640 942 | 12/1988 | France . | |
| 88/00165 | 1/1988 | WIPO | 222/402.12 |
| 93/09057 | 5/1993 | WIPO . | |

*Primary Examiner*—Philippe Derakshani
*Attorney, Agent, or Firm*—Lowe, Price, LeBlanc & Becker

[57] ABSTRACT

A spray head is intended for attachment to a spray can having a pressure container, a control valve and an outflow channel for dispensing material, such as shaving gel, which expands after dispensing. The spray head has a flow channel that receives a biassed valve near the spray head outlet. A material expansion absorption arrangement is in communication with flow channel and interacts with a control part that controls spray head operation. The threshold pressure of the biassed valve is higher than the threshold pressure needed for operating the material expansion absorption arrangement. After dispensing a quantity of material, the material expansion absorption arrangement can absorb expanding residual material so that on subsequent use, the material expansion absorption arrangement is returned first to the initial position before the control valve of the spray can is opened. A spray can with such a spray head is also described.

10 Claims, 4 Drawing Sheets

SPRAY HEAD INTENDED FOR A SPRAY CAN, AND SPRAY CAN PROVIDED WITH SUCH A SPRAY HEAD

BACKGROUND OF THE INVENTION

The present invention relates to a spray head intended for a spray can having a pressure container, a control valve and an outflow channel for dispensing a material, in particular shaving gel, which expands after dispensing, which spray head comprises a flow channel with an inlet and an outlet, whereby the inlet can be placed in communication with the outflow channel of the spray can, and also comprises a control part, for controlling the valve of the spray can. In this case expansion after dispensing also refers to after-expansion such as that occurring, for example, on dispensing of foam material, such as shaving foam or the like. Such foam is formed in the spray head, but expands further after dispensing.

Such a spray head is known from WO-A-93/09057, which describes a spray can for dispensing foam-forming gel, in particular shaving gel, in which a flange is present around the dispensing nozzle of the spray head, which flange is provided with a notch below the outflow opening. This means that expanding material residues which have remained behind in the flow channel after use of the spray head flow downwards. These foaming residues consequently do not come into contact with any cap which may be placed over the spray head.

This 1057 international patent application outlines the problem of expansion of residues of material, such as, for example, shaving gel, which have remained behind in the spray head after use of the spray can.

In the case of the spray cans according to the prior art the foam formed emerges from the dispensing nozzle and can lead to considerable soiling of the spray head, any cap which may be placed thereon, and the spray can. This is undesirable not only for aesthetic reasons, but such soiling makes use of the spray can less pleasant and can ultimately lead to the material drying out and blocking the spray head. In the last-mentioned case the spray can can no longer be used. Moreover, dry residues mix with fresh material to be dispensed and consequently reduce the performance of the dispensed material.

The solution to the abovementioned problem, disclosed in WO-A-93/09057, has not proved satisfactory in practice, since in that case expanding foam still emerges from the dispensing nozzle. This foam material can lead to soiling and possibly blockage.

SUMMARY OF THE INVENTION

The object of the present invention is to eliminate completely the abovementioned disadvantages of the prior art, and to that end the invention is characterized in that near the outlet of the spray head the flow channel comprises a biassed valve, in that material expansion absorption means which are in communication with the flow channel are present, and said material expansion absorption means interact with the control part, and in that the threshold pressure of the biassed valve is higher than the threshold pressure for putting the material expansion absorption means into operation, all the above being such that, after dispensing of a quantity of material, the material expansion absorption means can absorb expanding residual material, and in that on subsequent use the material expansion absorption means are returned first of all to the initial position before the control valve of the spray can is opened.

When the spray head according to the invention is used on a spray can, after a quantity of material has been dispensed no further expanding residual material will leave the dispensing nozzle. The expanding residual material will be absorbed by the material expansion absorption means.

When a spray can with such a spray head is used again after a certain period of time, the material expansion absorption means will first be emptied by way of the flow channel, the biassed valve and through the outlet. The expanded residual material is therefore in this case first forced out of the outlet, following which the control valve of the spray can is opened and material can be dispensed.

Since the expanded residual material is present in a sealed space, drying out or oxidation will not occur, or will only occur extremely slowly.

When the spray head according to the present invention is used the problems of the prior art no longer occur. The spray head is always clean, with the result that its use is more pleasant, and blockage can no longer occur.

It will be clear that the actual threshold pressures of the biassed valve and the material expansion absorption means depend on many factors, such as, for example, the pressure in the spray can used, the pressure required for opening the control valve, the material to be dispensed, the ambient temperature etc.

The most frequently used spray can is the conventional aerosol can, which comprises an outflow channel which extends in the lengthwise direction of the can and at the same time forms the control valve. The valve can be opened by pressing said outflow channel against the action of a spring.

Material to be dispensed with the spray head according to the invention can be shaving gel, which comprises a gel paste and a liquid propellant mixed therewith, such as isopentane. Shaving gel is generally dispensed from a spray can with a so-called bag-in-can system, which means that a bag connected to the control valve contains the gel to be dispensed with propellant, while a separate propellant is present in the spray can for emptying the bag, which propellant is often a hydrocarbon such as propane, butane or the like. A compressed gas such as air, nitrogen or carbon dioxide etc. can also be used for this purpose. In this case the use of the biassed valve has the advantage that the fall in pressure occurring during dispensing has little influence on the rate at which material is dispensed.

The material expansion absorption means preferably comprise a piston chamber with a piston, which piston chamber is in communication with the flow channel by way of an opening which is small relative to the transverse dimensions of said chamber, while the piston can shut off said opening, and interacts with the control part. It is important that the opening connecting the flow channel to the piston chamber is closed during dispensing of material from a spray can. This is achieved by the piston. During use, the control part can be operated with a finger by a user. When the control part is pressed the piston shuts off said opening.

A small opening is preferred because the pressure in a spray can used is often relatively high, and the piston chamber must be prevented from being filled with material prematurely during dispensing of material. By selecting a sufficiently small opening, expansion of residual material after use is not impeded, but it is ensured that, through the sudden pressure increase on opening of the control valve of the spray can, the finger of the user does not slip off the control part and allow the piston chamber to be filled with material. The force which is applied to the finger of the user through the sudden pressure increase depends on the dimensions of said opening. It is noted that the surface of the opening on which the pressure from the spray can acts is relatively small compared with the surface of the piston head. The force experienced by the user when the pressure of the spray can acts upon the surface of the piston head is therefore several times greater than the force experienced when said pressure acts only on the part of the piston which shuts off the opening.

In a special embodiment the material expansion absorption means comprise bellows, which bellows are in communication with the flow channel by way of an opening which can be shut off by said bellows. In this connection bellows can also be understood to include a deformable wall part of the spray head. What is essential here again is that during dispensing of material by the spray head the connection between the flow channel and the bellows is interrupted. This interrupting of the connection can be achieved in many different ways. For example, a projection on the inside wall of the bellows can interrupt said connection by, for example, shutting off a passage to the flow channel or by pressing against a deformable connecting channel and shutting it. The above will be explained in further detail in the description of the figures.

The bellows preferably form the control part. In other words, the spray head can be controlled by pressing on the bellows with a finger.

In this way a very simple action of the spray head is obtained when the latter is fixed on a spray can. For use of the can, a user presses on the bellows, said bellows empty, then shut off the opening to the flow channel, and subsequently open the control valve of the spray can in order to dispense material.

The biassed valve in the flow channel near the outlet can be designed in many different ways, but it is advantageously designed in the form of a sealing ring fixed in the channel, while the opening of said sealing ring, viewed in the envisaged outflow direction of material to be dispensed, interacts under a bias with a conical pin, which pin is fixed relative to the flow channel. Said biassed valve ensures that the communication with the environment is always interrupted until a certain threshold pressure is exceeded. This ensures that expanding residual material does not leave the flow channel to the environment, with all the adverse consequences which this would entail. When residues of material, for example shaving gel, expand in the flow channel after use, a rise in pressure occurs locally, and is absorbed by the material expansion absorption means, for example bellows or a piston chamber. The threshold pressure of the biassed valve therefore must be higher than the threshold pressure for putting the material expansion absorption means into operation.

The ratio between the threshold pressure of the biassed valve in the flow channel and the threshold pressure of the material expansion absorption means is preferably 5:1 to 2:1, and it is particularly preferable for said ratio to be 3:1. The ratio between the threshold pressure of the biassed valve and the pressure in a used spray can advantageously lies between 1:4 and 1:5.

Finally, the invention provides a spray can, at least comprising a container under pressure, a control valve and an outflow channel, which spray can is provided with a spray head according to the invention.

DESCRIPTION OF THE PREFERRED EMBODIMENTS

Figure 1:
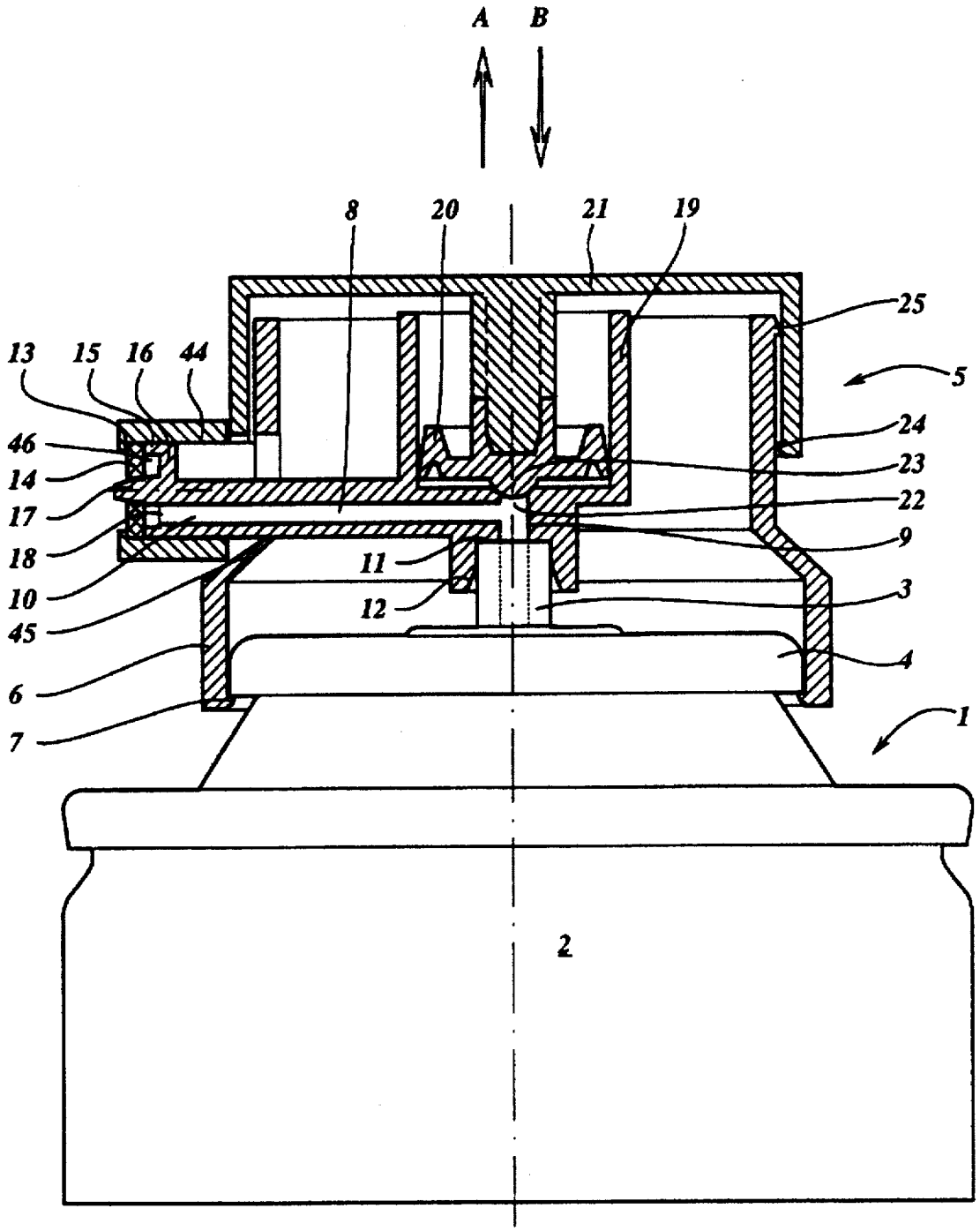
FIG. 1 shows a section of a preferred embodiment of a spray head according to the invention.

FIG. 1 shows a conventional spray can 1, with a container 2 under pressure, containing shaving gel and a liquid propellant, in this case isopentane, in a bag which is not described in any further detail, which bag is fixed in the can. The can also contains a propellant (butane), which serves to empty the bag 1 by squeezing, at a pressure of approximately 3 bar. The spray can 1 further comprises an outflow channel 3, which also serves to open the control valve of the spray can 1, which valve is not shown in any further detail and can be a conventional design. A beaded edge 4 is also present.

A preferred embodiment of the spray head according to the invention is indicated in general by 5, and can be made of, for example, plastic. The spray head 5 comprises a housing part 6 with a shoulder 7, which interacts with the beaded edge 4 of the spray can 1 in order to fix the spray head 5. A flow channel 8, with an inlet 9 and an outlet 10, is also present.

The inlet 9 comprises a stop 11 and a conical inside wall 12, which interact in a sealing manner with the outflow channel 3 of the spray can 1. The above are also designed in such a way that the stop 11 lies with some bias against the outflow channel 3, in order to prevent leakage. This seal can, of course, also be obtained in another way, for example by a force fit or a glued connection.

The outlet 10 is shut off by means of a sealing ring 14 clamped in a seat 13, which seat 13 forms part of a bush 44 which is fixed on the flow channel 8.

The ring 14 is pressed against the seat 13 by an annular stop 15 on a disc-shaped part 16. The disc-shaped part 16 comprises a central projecting conical pin 17 and an opening 18, which is in communication with the flow channel 8. The conical pin together with the sealing ring 14 forms the valve which is biassed. The disc-shaped part 16 in this embodiment is integral with the wall of the flow channel 8. Between the ring 14 and the part 16 is an annular space 46, which serves to produce uniform dispensing of material through the opening of the ring 14 along the pin 17.

The bias of the valve can be adjusted in many different ways. For example, one could consider the thickness and the material of the ring, the dimensions of the seat 13 and the stop 15, or the angle of the conical opening 18 in the ring and that of the conical pin 17.

The material expansion absorption means are designed in the form of a piston chamber 19 and a piston 20 which is freely movable therein. The piston 20 interacts with, or is integral with, a control part 21, by means of which the spray head is controlled. The piston chamber 19 is in communication with the flow channel 8 by way of a narrow passage 22. In the position shown in the figure said passage 22 is shut off by a sealing element 23 present on the piston 20.

The control part comprises stroke-limiting means in the form of a shoulder 24, which can interact with a shoulder 25 on the housing part 6. This prevents the piston 20 from accidentally leaving the piston chamber 19.

The spray head also comprises a hinge 45, which serves to make the flow channel 8 pivot slightly when the control valve of the spray can is operated through action on the flow channel 3.

The assembly shown in the figure works as follows:

In the position shown, when a user presses with a finger on the control part 21 (in the direction of arrow B) the outflow channel 3 of the spray can 1 is depressed and the control valve opened. At that moment, under the influence of the pressure in the container 2, shaving gel can flow by way of the inlet 9 into the flow channel 8 and, by way of the outlet 10 and the annular space 46 between the sealing ring 14 and the conical pin 17, can leave the spray head.

After a suitable quantity of gel has been dispensed, the control part 21 is released, and both the control valve and the biassed valve, i.e. the sealing ring 14 and the conical pin 17, close. The residues of gel remaining in the flow channel 8 will expand depending on the propellant used and the ambient temperature. The expanding material presses the piston 20 in the piston chamber 19 in the direction of arrow A, and the volume increase occurring is absorbed in this way.

At the commencement of a subsequent dispensing operation, the user will press with a finger on the control part 21, and first of all with the aid of the piston 20 force the residues of expanded material out of the piston chamber 19 by way of the flow channel 8 and the biassed valve, and out of the spray head. Only when the piston has reached the position shown in FIG. 1 again, and the piston chamber 19 being empty, the control valve of the spray can 1 is opened again, and only then can shaving gel be dispensed, as described earlier.

The sealing element 23 is made in a convex shape and interacts with a correspondingly shaped seat around the passage 22. This sealing action is of great importance, since if this seal is inadequate there is a risk that when the control valve of the spray can is opened the pressure prevailing in the spray can could act upon the entire surface of the piston head. As a result of this, the user's finger could slip off the spray head, and uncontrolled dispensing could temporarily occur. Apart from a convex element, other shapes are also possible. Moreover, the seat could additionally be provided with sealing means, such as a sealing edge.

It can be advantageous to provide the piston 20 with spring means, which support opening of the passage 22 after use of the spray head for dispensing of a quantity of material. Such spring means could be in the form of flexible lips on the piston head, which lips can interact with the inside wall of the piston chamber 19 around the passage 22 or, for example, a draw spring at the other side of the piston head which can interact with the open end of the piston chamber 19. The presence of the spring means makes it possible to give the piston head a relatively large surface, with the result that the threshold pressure of the biassed valve can be reduced.

The volume to be absorbed by the expansion absorption means depends on the material to be dispensed, the propellant present therein and the ambient temperature. The actual dimensions of the parts of the piston head can be selected suitably for the envisaged application by the average person skilled in the art.

Figure 2:
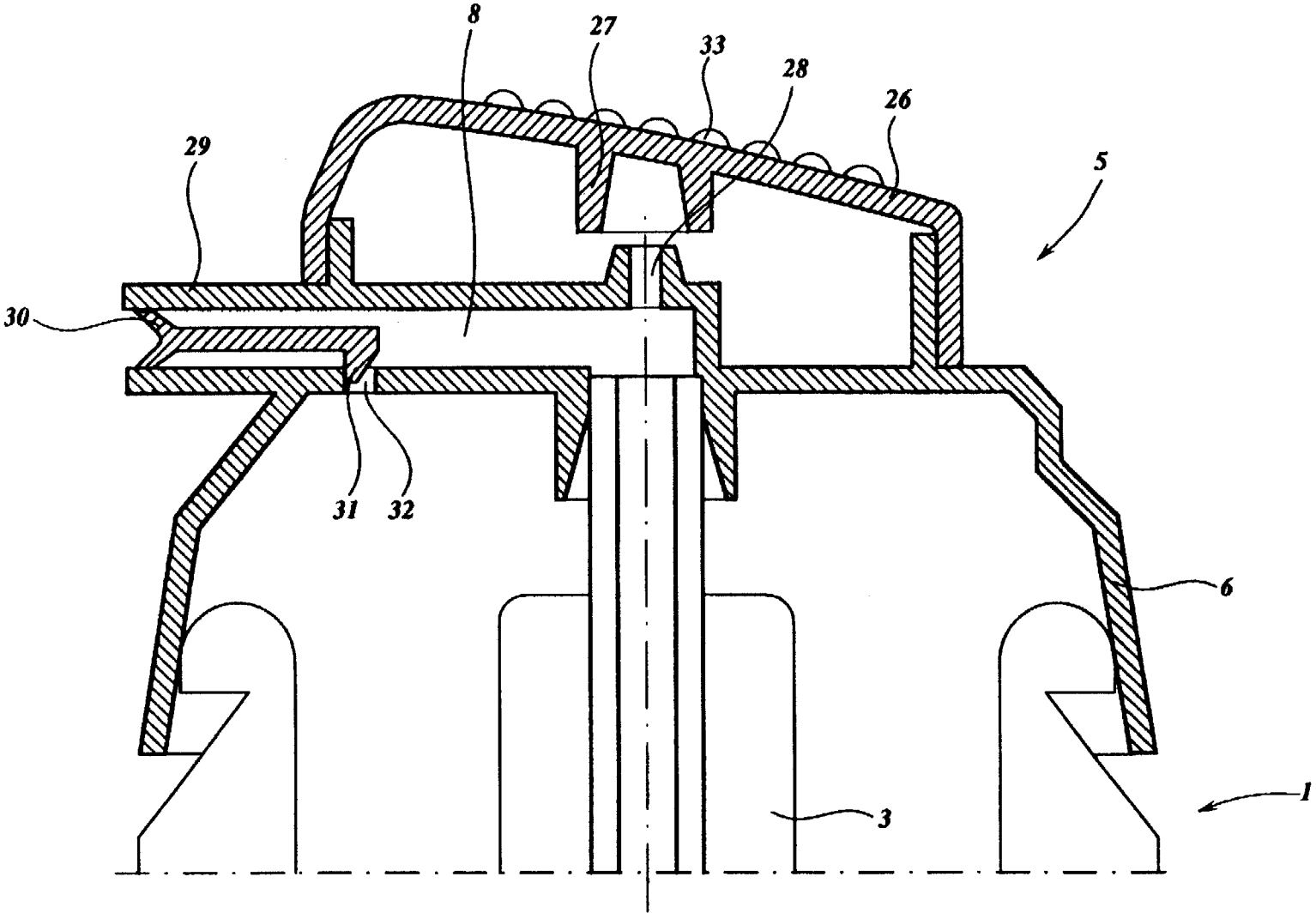
FIGS. 2–4 show sections of other embodiments of the spray head according to the invention.

In the embodiment shown in FIG. 2 the material expansion absorption means are in the form of bellows 26, having on the inside a sealing cap 27 which can interact and produce a seal with the outside wall of the passage 28. The bellows 26 are advantageously made of a flexible plastic. The biassed valve here is in the form of a sealing element 29 which, on the one hand, comprises a cup-shaped seal 30 and, on the other hand, is fixed by means of a lug 31 in a recess 32 in the wall of the flow channel 8. This design of the spray head can be fixed by means of a snap connection to the beaded edge of a conventional spray can.

During use, a finger presses on the bellows 26, which are suitably provided with ribs 33. The bellows 26 are deformed in the process in such a way that the sealing cap 27 shuts off the passage 28, and the control valve of the spray can 1 is opened. Released material can be dispensed through the flow channel 8 and along the sealing element 29. After the dispensing operation has been completed, the finger is taken off the bellows 26, with the result that the control valve closes and the bellows 26 return automatically to the initial position. Any expanding residues of gel will consequently be taken up in the bellows 26. As a result of the underpressure created by the bellows 26, expansion is accelerated and the sealing action of the sealing element 29 supported.

On subsequent use, the bellows 26 are depressed and the material present therein dispensed first, until the sealing cap is again brought into contact with the passage 28, and the control valve is opened.

Figure 3:
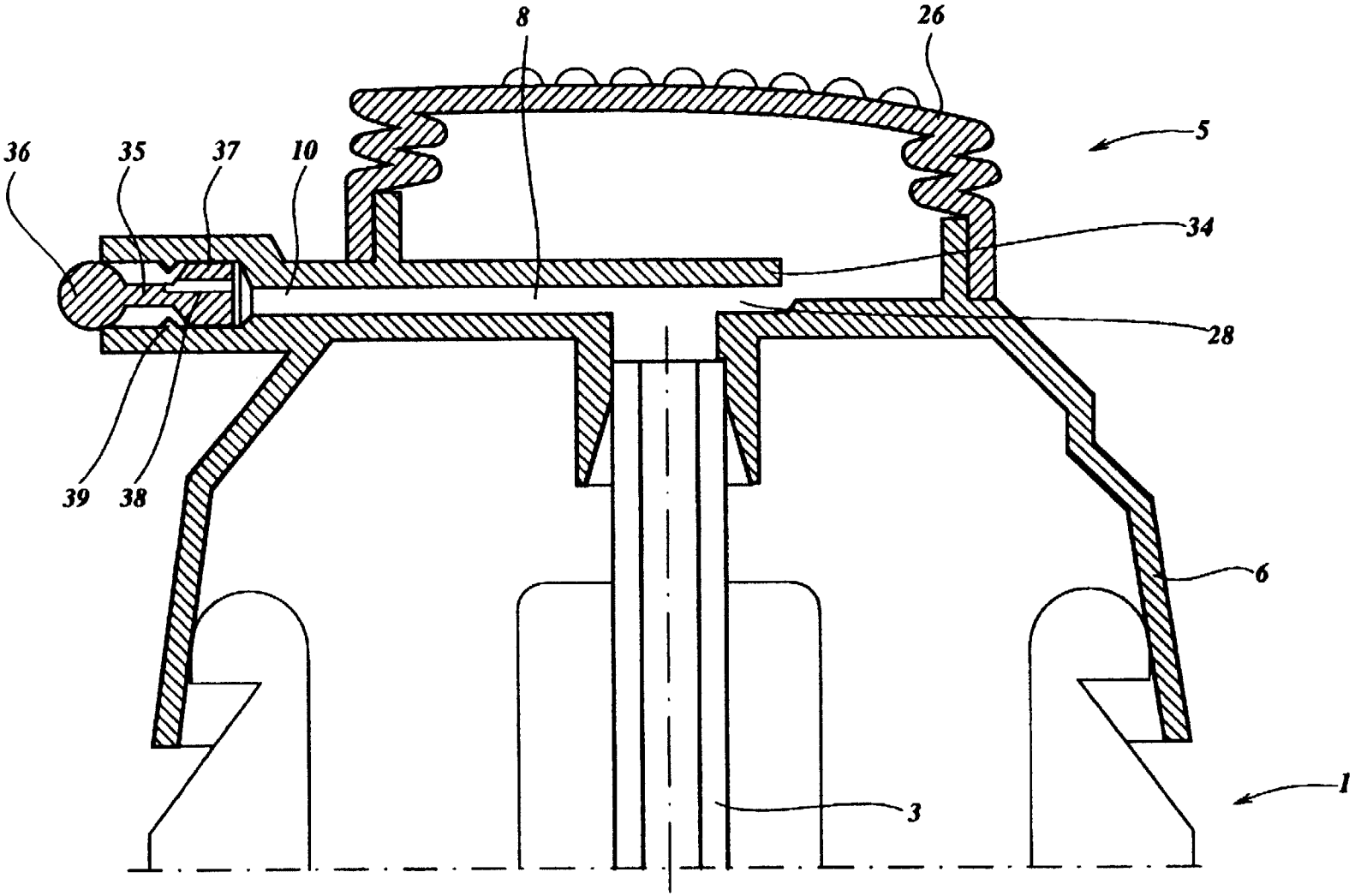

The embodiment of FIG. 3 shows considerable similarity with that of FIG. 2. However, the passage between the interior of the bellows 26 and the flow channel 8 is in this case formed by a deformable passage 34, which shuts off the passage to the flow channel 8 when the bellows 26 are depressed.

The biassed valve comprises a sealing element 35 with a convex sealing part 36 and a fixing part 37 connected thereto which has a passage 38 for material to be dispensed. Through interaction of the part 37 with the circular shoulder 39 in the outlet 10, the sealing part 36 is forced against the outlet under pre-compression. When the pressure in the flow channel is sufficiently high, the sealing part 36 will be released slightly from the outlet. Here again, an internal underpressure promotes the sealing effect of the sealing part 36.

Figure 4:
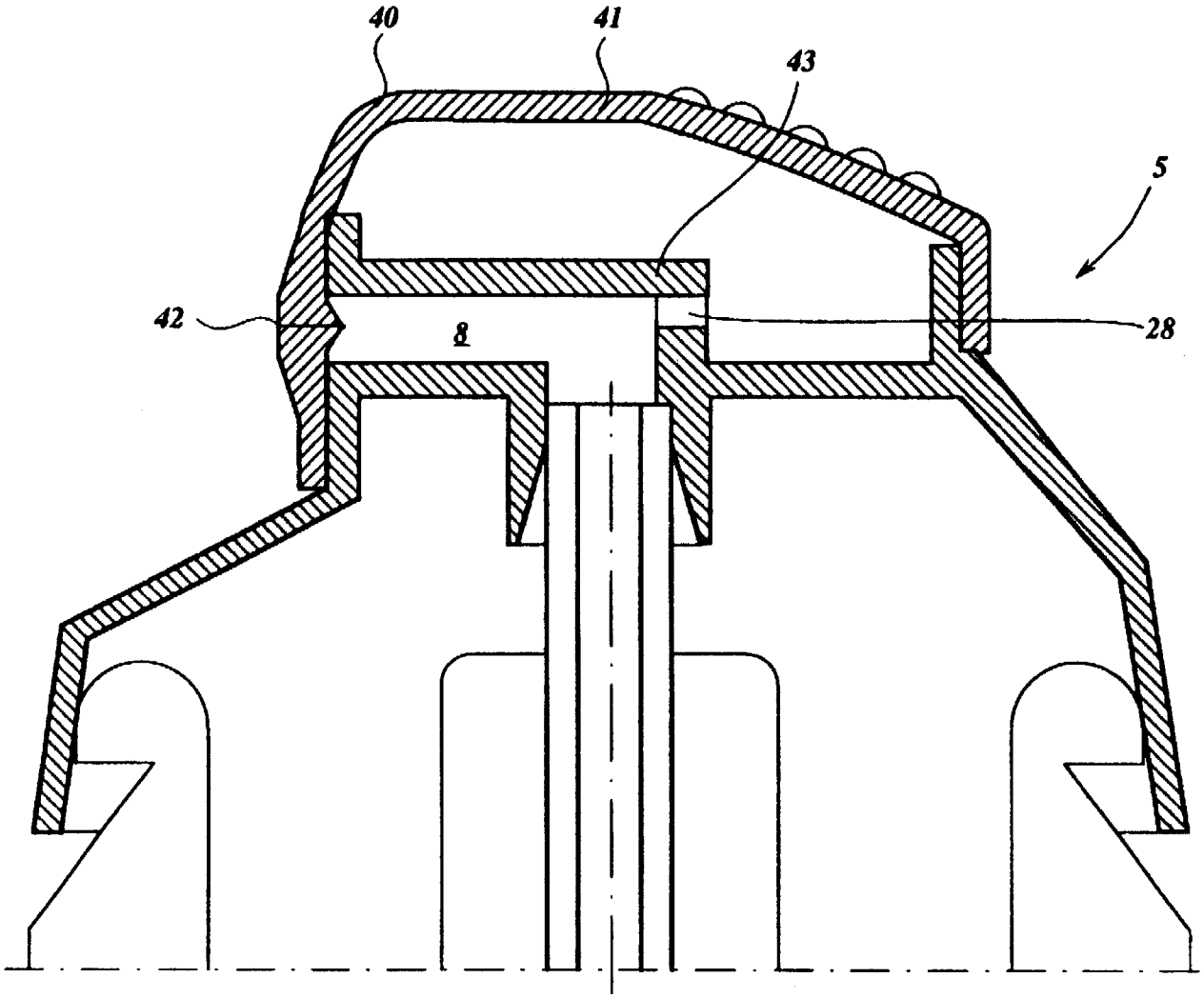

FIG. 4 shows a spray head 5 according to the invention with a part 40 which forms both the bellows 41 and the biassed valve 42. The biassed valve 42 in this embodiment is a local incision of the wall of the part 40 which allows through material only above a certain pressure. The passage from the bellows 41 to the flow channel 8 can be closed through interaction of the bellows with a deformable passage 43.

What is claimed is:

1. A spray head for a spray can having a pressure container, a control valve and an outflow channel for dispensing a material which expands after dispensing, said spray head comprising a flow channel having an inlet and an outlet, the inlet being communicable with the outflow channel of the spray can; a control part operable to control the valve of the spray can; a biassed valve located in the spray head outlet; and a material expansion absorption arrangement in communication with the flow channel for interacting with the control part to absorb expanding residual material wherein a predetermined, threshold pressure of the biassed valve is higher than a predetermined threshold pressure needed to put the material expansion absorption arrangement into operation, whereby after dispensing of a quantity of material, the material expansion absorption arrangement can absorb expanding residual material from the control valve, and on a subsequent use, the material expansion absorption arrangement is returned first to an initial position before the control valve of the spray can is opened.

2. A spray head according to claim 1, wherein the material expansion absorption arrangement includes a piston chamber and a piston, wherein said piston chamber is in communication with the flow channel through an opening which is small relative to transverse dimensions of said chamber, said piston positioned to shut off said opening and interact with the control part to operate the control valve.

3. A spray head according to claim 1, wherein the material expansion absorption arrangement comprises a bellows in communication with the flow channel with an opening which can be shut off by said bellows.

4. A spray head according to claim 3, wherein said bellows form said control part.

5. A spray head according to claim 1, wherein the biassed valve in the flow channel includes a sealing ring fixed in the channel, wherein an opening of said sealing ring, viewed from an outflow direction of material to be dispensed, interacts under a bias with a conical pin which is fixed relative to the flow channel.

6. A spray head according to claim 1, wherein a ratio between the threshold pressure of the biassed valve in the flow channel and the threshold pressure of the material expansion absorption arrangement is 5:1 to 2:1.

7. A spray head according to claim 6, wherein the ratio between the threshold pressure of the biassed valve in the flow channel and the threshold pressure of the material expansion absorption arrangement is approximately 3:1.

8. A spray head according to claim 1, wherein said material is a shaving gel.

9. A spray can, comprising a pressurized container; an outflow channel; a control valve disposed in said outflow channel; and a spray head comprising a flow channel having an inlet and an outlet, the inlet being communicable with the outflow channel of the spray can; a control par operable to control the valve of the spray can; a biassed valve located in the spray head outlet; and a material expansion absorption arrangement in communication with the flow channel for interacting with the control part to absorb expanding residual material, wherein a predetermined threshold pressure of the biassed valve is higher than a predetermined threshold pressure needed to put the material expansion absorption arrangement into operation, whereby after dispensing of a quantity of material, the material expansion absorption arrangement can absorb expanding residual material from the control valve, and on a subsequent use, the material expansion absorption arrangement is returned first to an initial position before the control valve of the spray can is opened.

10. A spray can according to claim 9, wherein said material is a shaving gel.

* * * * *